US006614328B2

(12) United States Patent
Son et al.

(10) Patent No.: US 6,614,328 B2
(45) Date of Patent: Sep. 2, 2003

(54) RADIO FREQUENCY FILTER OF COMBLINE STRUCTURE HAVING FREQUENCY CUT-OFF CIRCUIT AND METHOD FOR IMPLEMENTING THE SAME

(75) Inventors: Mi-Hyun Son, Seoul (KR); Seong-Soo Lee, Kyonggi-do (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 10/080,512

(22) Filed: Feb. 25, 2002

(65) Prior Publication Data

US 2002/0171514 A1 Nov. 21, 2002

(30) Foreign Application Priority Data

Feb. 26, 2001 (KR) ..... 2001-9656

(51) Int. Cl.[7] ..... H01P 1/20; H01P 1/205
(52) U.S. Cl. ..... 333/202; 333/203
(58) Field of Search ..... 333/203, 202, 333/204, 205, 219, 176

(56) References Cited

U.S. PATENT DOCUMENTS 4,963,843 A * 10/1990 Peckham ..... 333/203
5,136,269 A * 8/1992 Seitzer et al. ..... 333/204
5,543,764 A * 8/1996 Turunen et al. ..... 333/202
6,323,745 B1 * 11/2001 Toncich ..... 333/204

* cited by examiner

*Primary Examiner*—Seungsook Ham
(74) *Attorney, Agent, or Firm*—Sughrue Mion, PLLC

(57) ABSTRACT

Disclosed is a radio frequency filter of a combline structure including a frequency cut-off circuit for cutting off a specific frequency from a frequency band having a given frequency bandwidth. The frequency cut-off circuit includes an inductive transmission line extending from the output terminal by a length determined to provide an approximate inductance corresponding to a calculated value approximate to an inductance for obtaining the specific frequency, and a capacitive element coupled to the approximate inductance provided by the inductive transmission line, so that it has a capacitance for obtaining the specific frequency. The inductive transmission line is connected to the capacitive element through a via hole formed at an end of the transmission line opposite to the output terminal, from which the transmission line extends. The invention also proposes a method for implementing the radio frequency filter.

8 Claims, 3 Drawing Sheets

RADIO FREQUENCY FILTER OF COMBLINE STRUCTURE HAVING FREQUENCY CUT-OFF CIRCUIT AND METHOD FOR IMPLEMENTING THE SAME

This application claims priority to an application entitled "Radio Frequency Filter of Combline Structure Having Frequency Cut-off Circuit and Method for Implementing The Same", filed in the Korean Industrial Property Office on Feb. 26, 2001 and assigned Serial No. 2001-9656, the contents of which are hereby incorporated by reference.

BACKGROUND OF THE INVENTION

1. Field of the Invention

The present invention relates to a radio frequency filter using transmission lines, and particularly to a radio frequency filter for cutting off a specific frequency from a given filtering frequency band, and a method for implementing such a radio frequency filter.

2. Description of the Related Art

In the field of portable communication equipment such as portable telephones, size and manufacturing cost are of great concern. Such concerns do not apply solely to portable communication equipment. Various techniques to address these concerns have been actively developed.

One method for achieving a reduction in size is to use a configuration, which can be implemented in a limited space, such as transmission lines (striplines or micro striplines), in place of a passive element occupying a large area. A representative example of such a configuration may be a filter implemented using transmission lines (striplines or micro striplines) to have a filter function for extracting signals of a desired frequency band while cutting off noise signals of other frequency bands. Such a filter may be used in various fields including radio communication systems. In radio communication systems, the filter can be used for a receiver to receive desired signals or for a transmitter to transmit desired signals.

An example of a conventional stripline filter is disclosed in U.S. Pat. No. 4,963,843 issued to Motorola, Inc. on Oct. 16, 1990. Now, a conventional combline stripline filter will be described in brief, with reference to the disclosure of U.S. Pat. No. 4,963,843.

The conventional combline stripline filter is designed using conductive strips each having one end connected to the ground and the other end capacitively loaded to the ground. That is, the combline stripline filter includes a substrate having top and bottom surfaces each forming a ground plane. An inner circuitry layer is formed between the top and bottom surfaces of the substrate. The combline stripline filter also includes a ground area having a plurality of angled edges coupled to the ground planes. The inner circuitry layer is formed by combline resonators each coupled to the ground at one end thereof and capacitively loaded to the ground at the other end thereof. This combline stripline filter uses pattern capacitors in that the combline resonators are arranged in an interlayered fashion.

However, such a stripline filter, which uses pattern capacitors having the above mentioned structure, has problems of increased layout size and an increased error rate occurring in the pattern capacitors due to interference. Furthermore, it is difficult to connect the stripline filter to other devices. Where the pattern capacitors are capacitively loaded to the ground, it is difficult to accurately calculate the loaded capacitance. Since the capacitance between each pattern capacitor and the ground may be varied depending on the material of the substrate, the initial manufacture of the stripline filter may be difficult. Furthermore, this stripline filter is restricted in terms of its size and position when it is connected to other devices. This is because the connection of each pattern capacitor to an input/output pad and the ground is made at ends of the substrate.

Similar to a general filter using a passive element, the above mentioned filter using transmission lines has a desired frequency bandwidth for its filtering operation. The frequency bandwidth is determined by the space between adjacent transmission lines, the width of each transmission line, and the capacitance of the pattern capacitors coupled to the transmission lines.

In pace with recent developments in the communication industries, more sub-divided frequency bands have been used. However, this causes a reduction in the width between adjacent allocated frequency bands. As a result, the allocated frequency bands may interfere with each other. For this reason, it may be impossible to provide radio services of a good quality. Where the filter uses a reduced frequency bandwidth in order to reduce the interference between the allocated frequency bands, another problem of a reduction in the gain of the filter occurs even though the interference is reduced.

SUMMARY OF THE INVENTION

Therefore, an object of the invention is to solve the above mentioned problems, and to provide a radio frequency filter using transmission lines, which includes a frequency cut-off circuit arranged at a specific position of the filter and adapted to cut off a specific frequency from a frequency band having a given frequency bandwidth, and a method for implementing the radio frequency filter.

Another object of the invention is to provide a radio frequency filter capable of cutting off a specific frequency from a given frequency band, using inductance and capacitance, and a method for implementing the radio frequency filter.

Another object of the invention is to provide a radio frequency filter capable of cutting off a specific frequency by fixing its inductance at a specific frequency band while varying its capacitance, and a method for implementing the radio frequency filter.

In accordance with one aspect, the present invention provides, in a radio frequency filter of a combline structure including an input terminal, an output terminal, transmission lines arranged in a pair, each of the transmission lines having a desired width while being connected to a capacitance compensating circuit through a via hole, whereby the radio frequency filter has a predetermined frequency bandwidth, a frequency cut-off circuit for cutting off a specific frequency from a frequency band having the predetermined frequency bandwidth, the frequency cut-off circuit comprising:

an inductive transmission line extending from the output terminal by a length determined to provide an approximate inductance corresponding to a calculated value approximate to an inductance for obtaining the specific frequency; and a capacitive element coupled to the approximate inductance provided by the inductive transmission line, so that it has a capacitance for obtaining the specific frequency;

wherein the inductive transmission line is connected to the capacitive element through a via hole formed at an end of the transmission line opposite to the output terminal, from which the transmission line extends.

In accordance with another aspect, the present invention provides, in a radio frequency filter of a combline structure including an input terminal, an output terminal, transmission lines arranged in a pair, each of the transmission lines having a desired width while being connected to a capacitance compensating circuit through a via hole, respectively, whereby the radio frequency filter has a predetermined frequency bandwidth, a method for cutting off a specific frequency from a frequency band having the predetermined frequency bandwidth, comprising the steps of:

calculating an inductance approximate to an inductance for obtaining the specific frequency;

determining a length of the inductive transmission line to extend from the output terminal, based on the approximate inductance;

calculating a capacitance of a capacitive element coupled to the approximate inductance provided by the inductive transmission line while being connected to the inductive transmission line through a via hole to obtain the specific frequency.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE PREFERRED EMBODIMENT.

Now, preferred embodiments of the present invention will be described in detail, with reference to the annexed drawings.

In accordance with the present invention, a radio frequency filter is implemented using transmission lines. As mentioned hereinbefore, transmission lines are mainly classified into striplines and micro striplines. Where a radio frequency filter is implemented using transmission lines, for which striplines or micro striplines may be used, the design thereof may be varied depending on the kind of transmission lines which are used.

Generally, such a radio frequency filter using transmission lines has a multilayered structure. The multilayered structure of the radio frequency filter may be varied depending on whether the radio frequency filter uses striplines or micro striplines for its transmission lines. For example, where the radio frequency filter uses micro striplines for transmission lines, it has a multilayered structure having two layers. However, where striplines are used for the transmission lines, the radio frequency filter has a multilayered structure having three layers.

First, the multilayered structure of a radio frequency filter designed using micro striplines will be described. In this case, a ground layer is arranged as a lower layer of the multilayered structure, whereas a filter layer having a designed pattern is arranged as an upper layer of the multilayered structure. The pattern is connected to the lower layer, that is, the ground layer, through via holes, or coupled to a capacitance compensating circuit through via holes.

On the other hand, the multilayered structure of a radio frequency filter designed using striplines further has another layer arranged on the filter layer of the multilayered structure in the above mentioned radio frequency filter designed using micro striplines. That is, in this multilayered structure, ground layers are disposed, as upper and lower layers, over and beneath the filter layer having a pattern designed using micro striplines. The upper ground layer is provided with a pattern corresponding to output and input terminals, and a pattern corresponding to a capacitance compensating circuit.

Although the radio frequency filter has a multilayered structure which is determined according to whether striplines or micro striplines are used for its transmission lines, as mentioned above, the pattern of its filter layer is the same in either case. Accordingly, the following description associated with a preferred embodiment of the present invention will be given irrespective of which transmission lines are used. That is, only a pattern of transmission lines according to the embodiment of the present invention will be illustrated, and the operation of the embodiment of the present invention will be described only in conjunction with the illustrated transmission line pattern.

Figure 1:
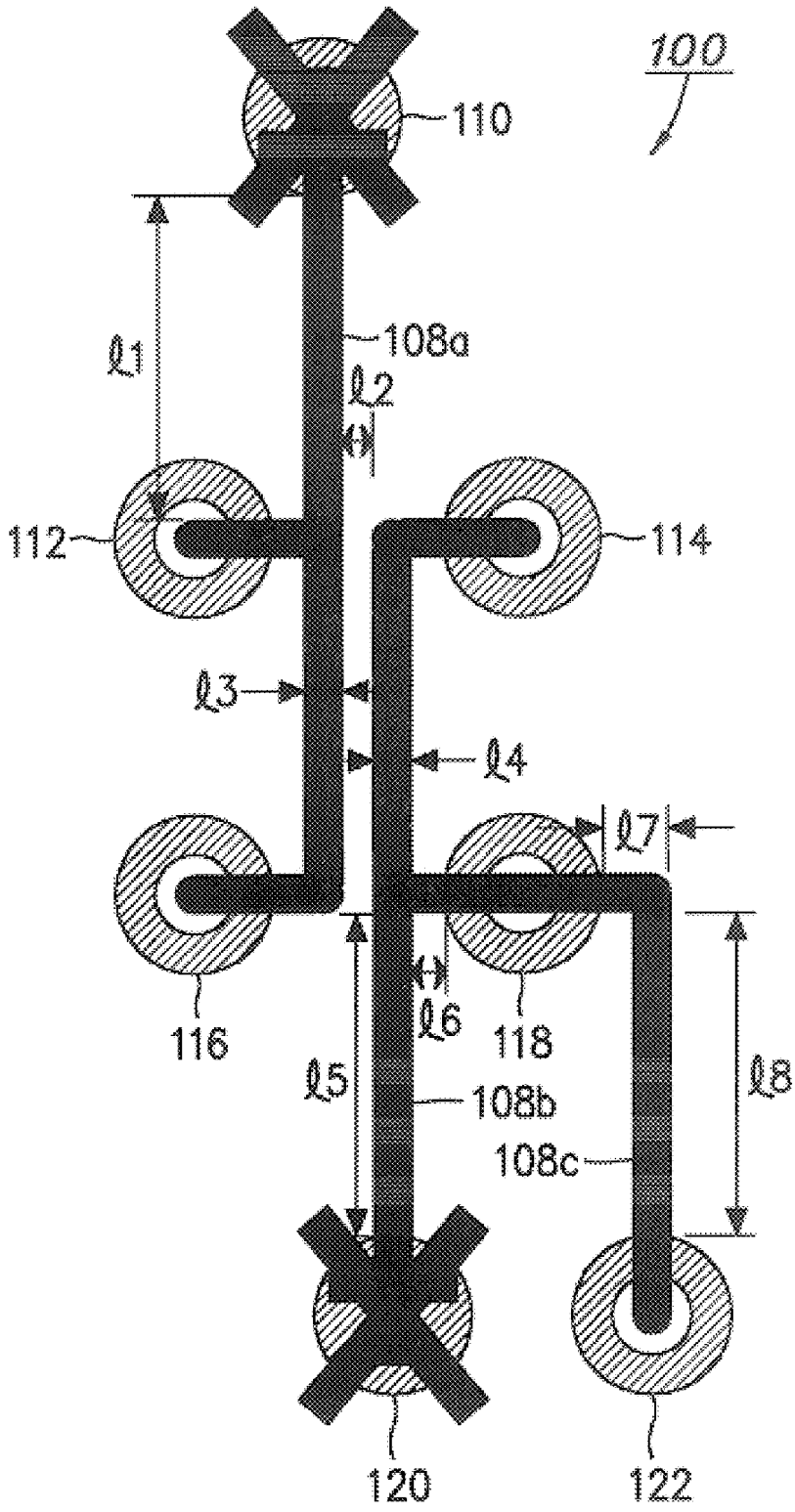
FIG. 1 is a view illustrating the pattern of a transmission line filter according to an embodiment of the present invention.

Referring to FIG. 1, a radio frequency filter having a pattern structure of the described embodiment of the invention is illustrated. The filter has a combline structure using transmission lines and includes a frequency cut-off circuit.

Referring to FIG. 1, a filter layer 100 is shown which has a combline structure to form a radio frequency filter on a general copper clad laminate (CCL) substrate, using transmission lines 108*a*, 108*b* and 108*c*. The transmission lines 108*a*, 108*b*, and 108*c* of the radio frequency filter designed on the filter layer 100 are connected to the ground through via holes 110, 112, 114, 116, 118, 120, and 122. That is, the transmission lines 108*a* and 108*b* are connected to a lower ground layer through the via holes 110 and 120. The transmission lines 108*a* and 108*b* are also coupled, through the via holes 114 and 116, to capacitance compensating circuits connected to the ground. The transmission line 108*a* is also coupled, through the via hole 112, to an input terminal connected to the ground. The transmission line 108*b* is coupled, through the via hole 118, to an output terminal connected to the ground. In order to implement a frequency cut-off circuit for cutting off a specific frequency from a given frequency band in accordance with the described embodiment of the present invention, the radio frequency filter has a desired inductance and a desired capacitance corresponding to the specific frequency to be cut off. The inductance is determined by the length of the transmission line 108*c*, that is, "l7+l8". For the capacitance, the radio frequency filter should be provided with a separate capacitive element. To this end, the transmission line 108*c* is connected, through the via hole 122, to a capacitive element coupled to the ground. Such a structure is called a "blind via hole" structure. Alternatively, the via holes 114, 116, and 122 may extend to the lower ground layer so as to connect the capacitance compensating circuits to the lower ground layer. This structure is called a "through via hole". The following description will be given in conjunction with a preferred embodiment in which the blind via hole structure is used.

Now, the structure of the radio frequency filter designed using the transmission lines 108*a*, 108*b*, and 108*c* will be described in detail. The transmission lines 108*a* and 108*b* of the radio frequency filter form one transmission line pair. One of this transmission line pair, that is, the transmission line 108*a*, is connected to an input terminal, whereas the other transmission line, that is, the transmission line 108*b*, is connected to an output terminal. Via holes 110, 112, 114, 116, 118, and 120 are formed at ends of the transmission lines 108*a* and 108*b*, and the input and output terminals, respectively. The via holes 110 and 120 connect the associated transmission lines 108*a* and 108*b* to the ground layer, respectively, whereas the via holes 114 and 116 connect the associated transmission lines 108*a* and 108*b* to capacitance compensating circuits. Each of the capacitance compensating circuits is implemented using the capacitor of a lumped circuit. The capacitance of each capacitance compensating circuit is determined to have an appropriate value corresponding to the frequency band to be filtered. The reason capacitance compensating circuits are used is that capacitance compensating circuits can allow the transmission lines composing the radio frequency filter to have a reduced length while allowing easy impedance matching and tuning. In particular, easy impedance matching and tuning is possible using a capacitor of a lumped device having an appropriate capacitance, and an adjustment of width or distance is not necessary to achieve an adjustment in capacitance as in conventional cases.

Although the capacitance compensating circuits are illustrated in FIG. 1 as being formed at the corresponding ends of the transmission lines 108*a* and 108*b*, respectively, the formation positions thereof may be optional in accordance with the structure of the radio frequency filter to be implemented. Respective capacitances possessed by the via holes 114 and 116 should also be taken into consideration in determining respective capacitances of the capacitance compensating circuits. Since each of the via holes 114 and 116 has a certain capacitance, this capacitance has to be reflected in setting the capacitance of the associated capacitance compensating circuit. The via hole structure of the radio frequency filter should also be taken into consideration in reflecting respective capacitances of the via holes 114 and 116. This is because each of the via holes 114 and 116 exhibits different capacitances between the above mentioned two via hole structures, that is, the blind via hole structure and the through via hole structure.

Meanwhile, the remaining via hole 122 connects the transmission line 108*c* to a capacitive element included in a frequency cut-off circuit. Hereinafter, this transmission line 108*c* is referred to as an "inductive transmission line". In order to achieve cutting-off of a specific frequency using the frequency cut-off circuit according to the illustrated embodiment of the present invention, it is necessary to determine an appropriate length of the inductive transmission line. In FIG. 1, the length of the inductive transmission line is indicated by "l7+l8". That is, the inductive transmission line extends from a point, where the inductive transmission line is connected to the output terminal through the via hole 118, by the length of "l7+l8". This inductive transmission line may have a bent structure as shown in FIG. 1, in order to reduce the size of the radio frequency filter. Once the frequency to be cut off is determined, it is possible to estimate the length of the inductive transmission line, based on a value obtained by a calculation based on the determined frequency along with a value experimentally obtained.

For example, the cut-off frequency can be determined using the following Equation 1:

$$f = \frac{1}{2\pi\sqrt{LC}} \qquad \text{[Equation 1]}$$

where, "f" represents the cut-off frequency, "L" represents an inductance, and "C" a capacitance.

As described above, the capacitive element connected to the inductive transmission line through the via hole 122 may be configured using the same element as that used in the capacitance compensating circuit. That is, the capacitive element may be implemented using the capacitor of a lumped device, as in the capacitance compensating circuit The capacitance of the capacitive element is coupled to the inductance of the inductive transmission line, so that it is determined by the specific frequency, to be cut off from a given frequency band, determined by the above described configuration. As described above, the inductance of the inductive transmission line is determined by the length of the inductive transmission line, which determines the frequency to be cut off. Accordingly, the inductance of the inductive transmission line can be appropriately determined in order to set a desired cut-off frequency. In other words, under the condition in which a desired inductance L and a desired cut-off frequency are determined, the capacitance C of the capacitive element can be determined by applying the determined values to Equation 1.

Where the lumped device is used for the capacitive element, it is possible to appropriately adjust the capacitance C of the capacitive element, if necessary. In this case, therefore, it is possible to vary the cut-off frequency. This is apparent by referring to Equation 1. Meanwhile, the capacitance of the capacitive element should be determined, taking into consideration the capacitance possessed by the via hole 122, as in the case in which the capacitance of each capacitance compensating circuit is to be determined. In this case, in determining the capacitance of the capacitive element, the capacitance possessed by the via hole 122 should be taken into consideration, as in the case of determining the capacitance of the capacitance compensating circuits. In this case, whether the radio frequency filter has a blind via hole structure or a through via hole structure should also be taken into consideration in reflecting the capacity of the via hole 122.

Figure 2:
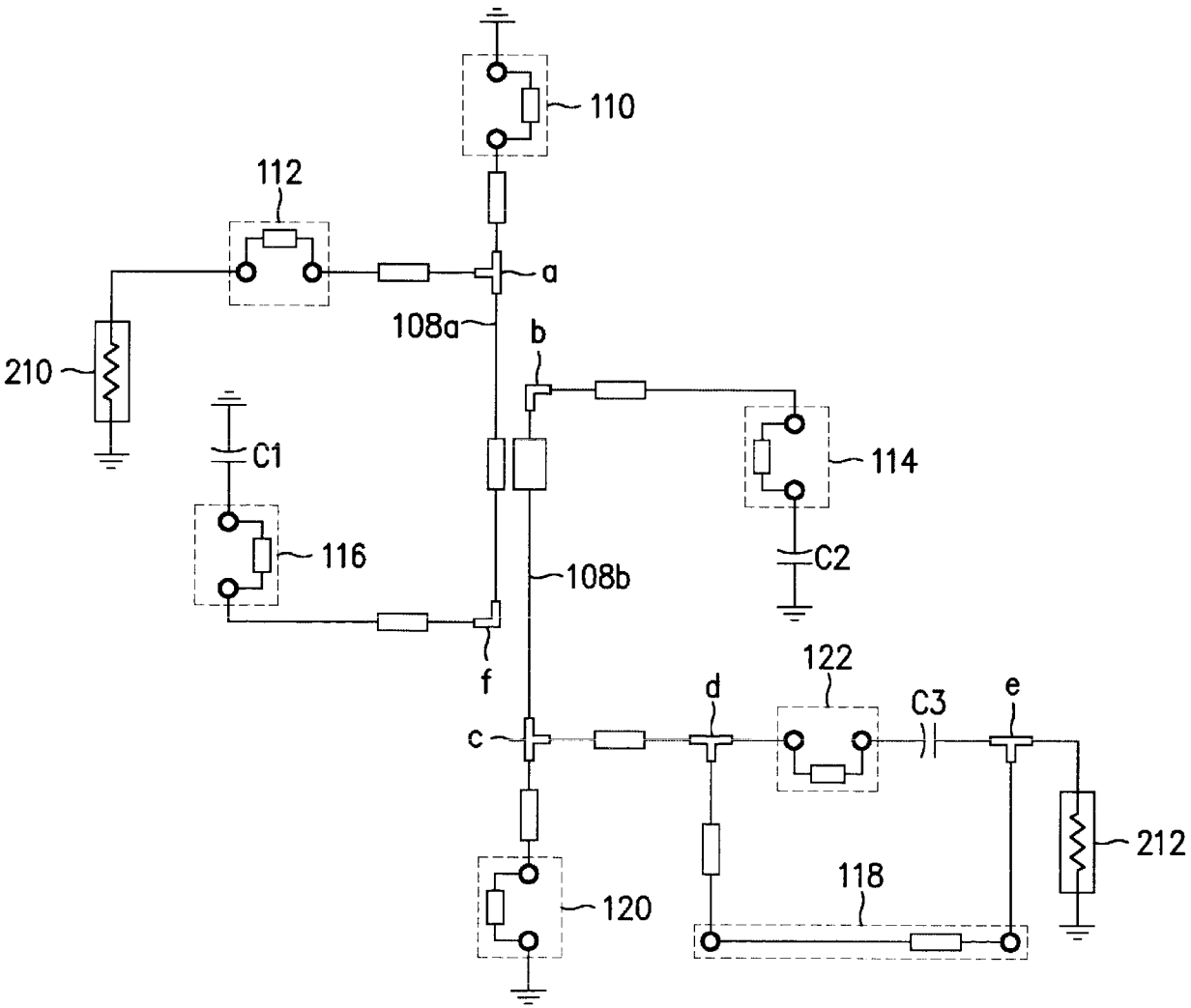
FIG. 2 is a circuit diagram illustrating a circuit corresponding to the pattern of the radio frequency filter shown in FIG. 1.

FIG. 2 illustrates a circuit corresponding to the above mentioned configuration of the radio frequency filter. Referring to FIG. 2, it can be seen that six via holes 110, 112, 114, 116, 118, 120, and 122, three capacitive elements c1, c2, and c3, and input and output terminals 210 and 212 are connected to transmission lines 108*a* and 108*b* associated therewith, respectively.

The via hole 110 connects the transmission line 108*a* to the ground, and the via hole 120 connects the transmission line 108*b* to the ground. The via hole 116 connects the transmission line 108*a* to the ground via the capacitance compensating circuit c1, and the via hole 114 connects the transmission line 108*b* to the ground via the capacitance compensating circuit c2. The transmission line 108*a* is connected to the input terminal through the via hole 112, whereas the transmission line 108*b* is connected to the output terminal through the via hole 118. Meanwhile, the via hole 122 connects the transmission line 108*b* to the ground via the capacitive element c3. In FIG. 2, "a" to "f" represent points where the transmission lines are bent or branched, respectively.

Figure 3:
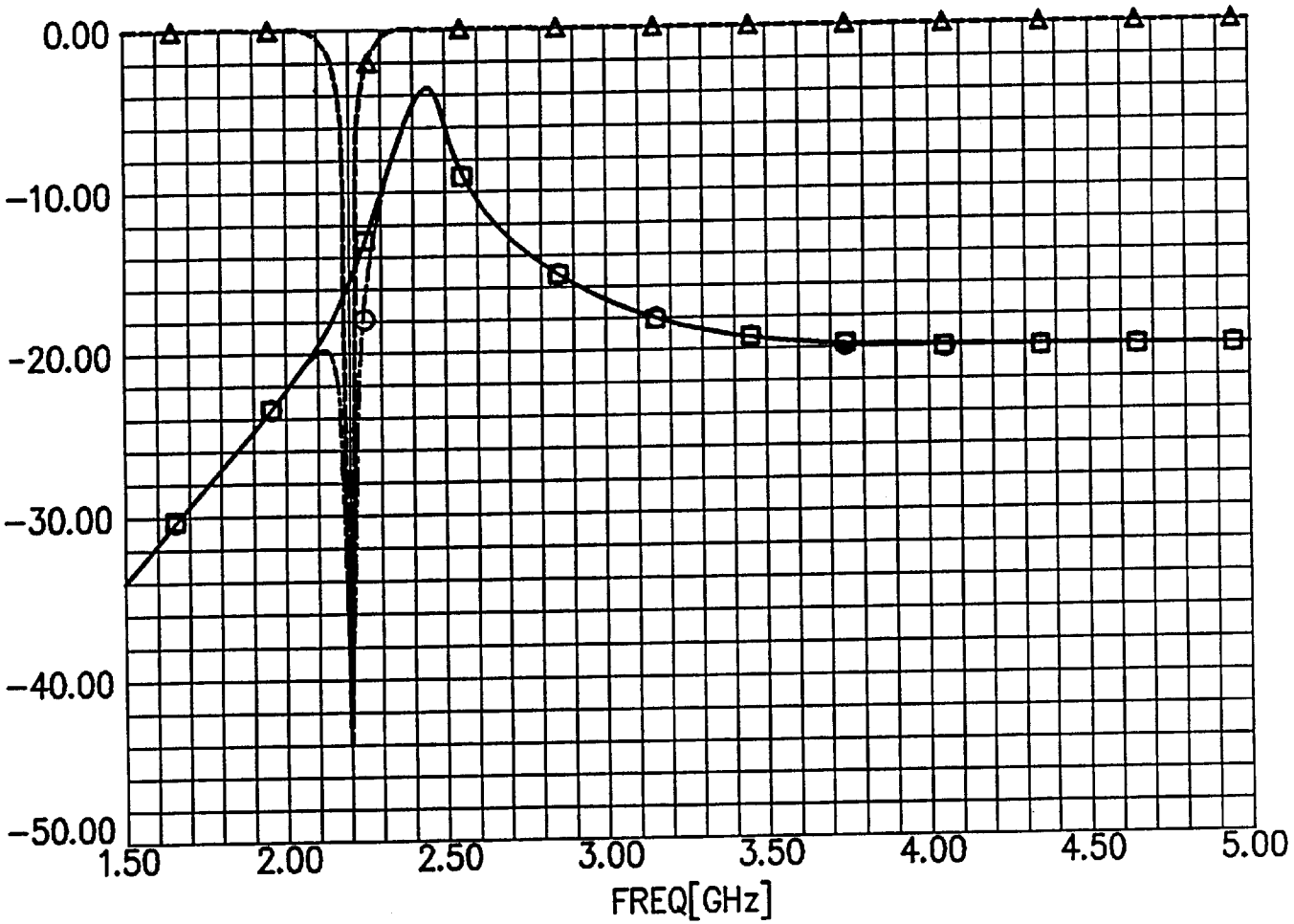
FIG. 3 is a graph showing the characteristics of the transmission line filter according the embodiment of the present invention.

FIG. 3 illustrates the characteristics of the transmission line filter according to the described embodiment of the present invention. Referring to FIG. 3, it can be seen that the frequency band of the radio frequency filter exhibits a reduction in gain at the cut-off frequency set by the frequency cut-off circuit. It can also be found that the cut-off frequency is determined by inductance L and capacitance C. That is, the radio frequency filter allows frequencies of a low band in a given frequency band to pass therethrough by virtue of the inductance L while allowing frequencies of a high band in the given frequency band to pass therethrough by virtue of the capacitance C. Accordingly, where the characteristic graphs based on the inductance L and capacitance C, and the characteristic graph of the radio frequency filter are simultaneously applied, a reduction in gain occurs at a specific frequency in the given frequency band by virtue of the characteristic graphs of the inductance L and capacitance C. Thus, it is possible to prevent interference among similar frequency bands by the frequency cut-off circuit according to the embodiment of the present invention, which cuts off a specific frequency.

The operation of the radio frequency filter having the above mentioned configuration according to the embodiment of the present invention will be described in detail.

The radio frequency filter filters signal components of a specific frequency band from a signal applied thereto at the input terminal 210 thereof, and outputs the resultant signal at the output terminal 212. The specific frequency band is determined by the capacitances of the capacitance compensating circuit c1 and c2 and the space between the micro striplines 108*a* and 108*b*. The signal outputted after the filtering of the signal, applied to the radio frequency filter at the input terminal 210, in the specific frequency band is shown in FIG. 3. Referring to FIG. 3, it can be seen that a considerable gain reduction occurs at a specific frequency in the specific frequency band. It can also be seen that the cut-off frequency is set to about 2.20 GHz. As described hereinbefore, the cut-off frequency is determined by the inductance given by the length of the transmission line 108*c* corresponding to "l7+l8" and the capacitance given by the capacitive element c3. That is, among signals of the specific frequency band filtered by the radio frequency filter, those of the cut-off frequency are cut off by virtue of the transmission line 108*c* having the length of "l7+l8" and the capacitive element c3. Accordingly, only the signals of the specific frequency band, from which the signals of the specific cut-off frequency are cut off, are outputted.

Although the radio frequency filter has a configuration for cutting off a frequency at one side of the specific frequency band in the above described embodiment of the present invention, it is possible to implement a configuration capable of cutting off specific frequencies at opposite sides of the specific frequency band. It will also be appreciated that a configuration capable of cutting off a frequency at a higher frequency side of the specific frequency band.

As is apparent from the above description, the present invention provides a radio frequency filter capable of cutting off frequencies having a possibility of adversely affecting the frequency band to be used, thereby achieving an improvement in the quality of radio communication services. In accordance with the present invention, capacitive elements are comprised of lumped elements. Accordingly, it is possible to adjust the frequency to be cut off.

While this invention has been described in connection with what is presently considered to be the most practical and preferred embodiment, it is to be understood that the invention is not limited to the disclosed embodiment, but, on the contrary, it is intended to cover various modifications within the spirit and scope of the appended claims.

What is claimed is:

1. In a radio frequency filter of a combline structure including an input terminal, an output terminal, transmission lines arranged in a pair, each of the transmission lines having a desired width and being connected to a capacitance compensating circuit through a via hole, whereby the radio frequency filter has a predetermined frequency bandwidth, a frequency cut-off circuit for cutting off a specific frequency from a frequency band having the predetermined frequency bandwidth, the frequency cut-off circuit comprising:

an inductive transmission line extending from the output terminal by a length determined to provide an approximate inductance corresponding to a calculated value approximate to an inductance for obtaining the specific frequency; and a capacitive element coupled to the approximate inductance provided by the inductive transmission line, the capacitive element having a capacitance for obtaining the specific frequency;

wherein the inductive transmission line is connected to the capacitive element through a via hole formed at an end of the transmission line opposite to the output terminal, from which the transmission line extends.

2. The frequency cut-off circuit according to claim 1, wherein the capacitive element is a capacitor of a lumped device.

3. The frequency cut-off circuit according to claim 1, wherein each of the transmission lines is a micro stripline.

4. The frequency cut-off circuit according to claim 1, wherein each of the transmission lines is a stripline.

5. The frequency cut-off circuit according to claim 1, wherein the inductive transmission line is bent at a desired bending length ratio.

6. The frequency cut-off circuit according to claim 1, wherein the inductance of the inductive transmission line and the capacitance of the capacitive element are calculated, based on the following Equation:

$$f = \frac{1}{2\pi\sqrt{LC}}$$

where, "f" represents the specific frequency, "L" represents the inductance, and "C" the capacitance.

7. In a radio frequency filter of a combline structure including an input terminal, an output terminal, transmission lines arranged in a pair, each of the transmission lines having a desired width and being connected to a capacitance compensating circuit through a via hole, respectively, whereby the radio frequency filter has a predetermined frequency bandwidth, a method for cutting off a specific frequency from a frequency band having the predetermined frequency bandwidth, comprising the steps of:

calculating an inductance approximate to an inductance for obtaining the specific frequency;

determining a length of the inductive transmission line to extend from the output terminal, based on the approximate inductance; and connecting a capacitive element to the inductive transmission line through a via hole, said capacitive element having a capacitance calculated to result in the radio frequency filter cutting off the specific frequency.

8. The method according to claim 7, wherein the inductance of the inductive transmission line and the capacitance of the capacitive element are calculated, based on the following Equation:

$$f = \frac{1}{2\pi\sqrt{LC}}$$

where, "f" represents the specific frequency, "L" represents the inductance, and "C" the capacitance.

* * * * *